US005200002A

United States Patent [19]

Hilzinger

[11] Patent Number: 5,200,002

[45] Date of Patent: Apr. 6, 1993

[54] AMORPHOUS LOW-RETENTIVITY ALLOY

[75] Inventor: Hans-Reiner Hilzinger, Maintal, Fed. Rep. of Germany

[73] Assignee: Vacuumschmelze GmbH, Fed. Rep. of Germany

[21] Appl. No.: 156,632

[22] Filed: Jun. 5, 1980

[30] Foreign Application Priority Data

Jun. 15, 1979 [DE] Fed. Rep. of Germany ..... 2924280

[51] Int. Cl.[5] ..... C22C 19/07; H01F 1/047

[52] U.S. Cl. ..... 148/304; 148/313; 148/403; 420/435

[58] Field of Search ..... 75/122, 134 F, 170, 75/171; 148/31, 32, 31.55, 31.57, 304, 313, 403; 420/435

[56] References Cited

U.S. PATENT DOCUMENTS 3,856,513 12/1974 Chen et al. .
3,986,867 10/1976 Masumoto et al. ..... 75/122
4,038,073 7/1977 O'Handley et al. .
4,079,430 3/1978 Fujishima et al. .
4,116,682 9/1978 Polk et al. ..... 75/122
4,144,058 3/1979 Chen et al. .
4,150,981 4/1979 O'Handley .
4,188,211 2/1980 Yamaguchi et al. .

FOREIGN PATENT DOCUMENTS 2364131 6/1974 Fed. Rep. of Germany .
2546676 4/1976 Fed. Rep. of Germany .
2555003 8/1976 Fed. Rep. of Germany .
2605615 9/1976 Fed. Rep. of Germany .
2708151 9/1977 Fed. Rep. of Germany .
2806052 10/1978 Fed. Rep. of Germany .
2835389 3/1979 Fed. Rep. of Germany .
51-73923 6/1976 Japan .
1525276 9/1978 United Kingdom .
1525959 9/1978 United Kingdom .

*Primary Examiner*—George Wyszomierski
*Attorney, Agent, or Firm*—Hill, Van Santen, Steadman & Simpson

[57] ABSTRACT

An amorphous, low-retentivity alloy contains cobalt, manganese, silicon and boron. The alloy has the composition $$(Co_aNi_bT_cMn_dFe_e)_{100-t}(Si_xB_yM_z)_t,$$

whereby T is at least one of the elements chromium, molybdenum, tungsten, vanadium, niobium, tantalumn, titanium, zirconium and hafnium and M is at least one of the elements phosphorous, carbon, aluminum, gallium, indium, germanium, tin, lead, arsenic, antimony, bismuth and beryllium and the following relationships apply: $0.39 \leqq a \leqq 0.99$; $0 \leqq b \leqq 0.40$; $0 \leqq c \leqq 0.08$; $0.01 \leqq d \leqq 0.13$; $0 \leqq e \leqq 0.02$; $0.01 \leqq d+e \leqq 0.13$; $a+b+c+d+e=1$; $18 \leqq t \leqq 35$; $8 \leqq xt \leqq 24$; $4 \leqq yt \leqq 24$; $0 \leqq zt \leqq 8$; and $x+y+z=1$. The inventive alloy is distinguished by a saturation magnetostriction $\leqq 5 \cdot 10^{-6}$ and is particularly suited for magnetic screens, sound heads and magnetic cores.

6 Claims, 1 Drawing Sheet

AMORPHOUS LOW-RETENTIVITY ALLOY

BACKGROUND OF THE INVENTION

The invention relates to an amorphous low-retentivity alloy, which contains cobalt, manganese, silicon and boron.

As is known, an amorphous metal alloy can be manufactured in a process of cooling a corresponding melt so quickly that it solidifies without any crystallization occurring. Thus the amorphous alloys can be obtained immediately upon casting thin bands whose thickness, for example, amounts to a few hundredths mm and whose width can amount to a few mm through several cm.

The amorphous alloys can be distinguished from crystalline alloys by means of x-ray diffraction methods. In contrast to crystalline alloys or materials, which exhibit characteristic sharp diffraction lines, the x-ray diffraction picture of an amorphous metal alloys has an intensity, which changes only slowly with the diffraction angle, and is similar to the diffraction picture for fluids or common glass.

Depending on the manufacturing conditions, the amorphous alloys can be entirely amorphous or comprise a two-phase mixture of both the amorphous and the crystalline state. In general, what is meant by an amorphous metal alloy is an alloy which is at least 50%, preferably at least 80% amorphous.

There is a characteristic temperature, the so-called crystallization temperature, for every amphorous metal alloy. If one heats the amorphous alloy to or above this temperature, then it is transformed into the crystalline state in which it remains after cooling. However during thermal treatments below the crystallization temperature, the amorphous state is retained.

Known low-retentivity amorphous alloys have a composition corresponding to the general formula $M_{100-t}X_t$, whereby M signifies at least one of the metal elements Co, Ni and Fe; and X signifies at least one of the so-called vitrifying elements B, Si, C and P; and t lies between approximately 5 and 40. Further, it is known that such amorphous alloys, in addition to the metal elements M, can also contain additional metal elements, such as the transition metal elements Cr, Mo, W, V, Nb, Ta, Ti, Zr, Hf and Mn and that, in addition to the vitrifying elements or, under certain conditions, even instead of these elements, the elements Al, Ga, In, Ge, Sn, Pb, As, Sb, Bi or Be, can also be present (see German OS 2,364,131; German OS 2,553,003; German OS 2,605,615; Japanese OS 51-73923).

Of particular interest among the amorphous low-retentivity alloys are those alloys which have a small magnetostriction, which is as disappearingly small as possible. The smallest possible saturation magnetostriction $\lambda_x$, is a significant pre-condition for good low-retentivity properties, i.e., a low coercivity and a high permeability. In addition, the magnetic properties of amorphous alloys, which have disappearingly small magnetostriction, are practically insensitive to deformations, so that these alloys can be easily wound into cores or can be processed into shapable screens, for example, fabrics of interlaced ribbons. Further, alloys with a zero magnetostriction are not induced into oscillations under alternating current operating conditions, so that no energy will be lost to mechanical oscillations. The core losses can therefore be kept very low. Moreover, the disruptive hum, which frequently occurs in electromagnetic devices, is also eliminated.

Within the above mentioned general composition range of low-retentivity amorphous alloys, there are known groups of alloys with particularly low magnetostriction. A group of these alloys has the composition $(Co_aFe_bT_c)_yX_{1-y}$, wherein T signifies at least one of the elements Ni, Cr, Mn, V, Ti, Mo, W, Nb, Zr, Pd, Pt, Cu, Ag and Au and X signifies at least one of the elements P, Si, B, C, As, Ge, Al, Ga, In, Sb, Bi and Sn. In addition, the following conditions are present: y is in a range of 0.7–0.9; a is in a range of 0.7–0.97; b is in the range of 0.03–0.25, and $a+b+c=1$ (see German O.S. 2,546,676).

Another known group of amorphous alloys with magnetostriction values between approximately $+5\cdot10^{-6}$ through $-5\cdot10^{-6}$ has a composition corresponding to the general formula $(Co_xFe_{1-x})_aB_bC_c$, wherein x lies in the range of approximately 0.84 through 1.0; a lies in the range from approximately 78 through 85 atomic %; b lies in the range from approximately 10 through 22 atomic %; c lies in the range from 0 through approximately 12 atomic %; and b+c lie in the range from approximately 15 through 22 atomic %. In addition, these alloys, with reference to the overall composition, can also contain up to approximately 4 atomic % of at least one other transition metal element such as Ti, W, Mo, Cr, Mn, Ni and Cu and up to approximately 6 atomic % of at least one other metalloid element such as Si, Al and P, without the desired magnetic properties being significantly diminished (see German 0.S. 2,708,151).

Low saturation magnetostrictions are found in amorphous alloys, which essentially consist of approximately 13 through 73 atomic % Co, approximately 5 through 50 atomic Ni, and approximately 2 through 17 atomic % Fe, wherein the total amount of Co, Ni and Fe is approximately 80 atomic %, and the remainder of the alloy essentially consists of B and slight contaminations. These alloys, with reference to the overall composition, can likewise contain up to approximately 4 atomic % of at least one of the elements Ti, W, Mo, Cr, Mn or Cu and up to approximately 6 atomic % of at least one of the elements Si, Al, C and P (see German 0.S. 2,835,389).

Finally, another known group of amorphous alloys with low saturation magnetostriction has the corresponding formula $(Fe_aCo_bNi_c)_x(Si_eB_fP_gC_h)y$, wherein a, b, c, e, f, g and h, respectively signify the mol fractions of the corresponding elements and $a+b+c=1$ and $e+f+g+h=1$ and x or, respectively, y signifies the overall amount in atomic % of the elements within the appertaining parentheses with $x+y=100$, and the following relationships are valid: $0.03\leqq a\ 0.12$; $0.40\leqq b\leqq0.85$; $0\leqq ey\leqq25$; $0\ \leqq fy\leqq30$, $0\leqq g+h\leqq0.8$ $(e+f)\ o\leqq e,f,g,h\leqq7$ and, preferably, $20\leqq y\leqq35$. Further, these alloys, with reference to their overall composition, can additionally contain 0.5 through 6 atomic % of at least one of the elements Ti, Zr, V, Nb, Ta, Cr, Mo, W, Zn, Al, Ga, In, Ge, Sn, Pb, As, Sb and Bi (see German 0.S. 2,806,052).

SUMMARY OF THE INVENTION

The object of the invention is to provide a low-retentivity alloy in which the amount of the saturation magnetostriction $|\lambda|_s\leqq5\cdot10^{-6}$.

In accordance with the invention, a low saturation magnetostriction is achieved in an amorphous alloy of the composition $(Co_aNi_bT_cMn_dFe_e)_{100-t}(Si_xB_yM_z)_t$, wherein T is at least one of the elements Cr, Mo, W, V, Nb, Ta, Ti, Zr and Hf; and M is at least one of the elements P, C, Al, Ga, In, Ge, Sn, Pb, As, Sb, Bi and Be, and wherein the following relationships are present:

$0.39 \leqq a \leqq 0.99$,
$0 \leqq b \leqq 0.40$,
$0 \leqq c \leqq 0.08$,
$0.01 \leqq d \leqq 0.13$,
$0 \leqq e \leqq 0.02$,
$0.01 \leqq d+e \leqq 0.13$,
$a+b+c+d+e=1$,
$18 \leqq t \leqq 35$,
$8 \leqq xt \leqq 24$,
$4 \leqq yt \leqq 24$,
$0 \leqq zt \leqq 8$, and
$x+y+z=1$.

In the above compositions and relationships, the metal elements in the parentheses form a metal or first group and the elements in the other parentheses form a metalloid or second group. In each group, the values or indexes a, b, c, d and e for the metal group and the values or indexes x, y and z for the second group are the atomic proportions of the appertaining element in its respective group. The values x+y+z have a total sum of 1 and the values a+b+c+d+e also equal 1. The values or indexes 100-t and t indicate the proportions or atomic percent of the respective groups in the alloy. The proportion of a single element in the alloy in atomic % corresponds to the product proceeding from the index of the corresponding element and the index of the appertaining group. For example, the silicon proportion x' in the alloy in atomic % is $x'=xt$.

The inventive alloy differs in composition from the various, known alloys with low magnetostriction particularly in that manganese with a minimum content $d'_{min}=d_{min}\cdot(100\text{-}t_{max})=0.65$ atomic % and silicon with a minimum content $x'=xt=8$ atomic % are prescribed as obligatory components. In addition, a relatively small maximum content of the optional components iron of $e_{max}(100\text{-}t_{min})=1.64$ atomic % is present.

Surprisingly, it has proven in the inventive alloy that the magnetostriction constant can be reduced down to zero by means of a corresponding proportioning the manganese content. The silicon content results in an increase of the crystallization temperature and a decrease of the melting temperature and therefore leads to an improved manufacturability of the amorphous alloy. As a result of the reduction of the difference between the melting and crystallization temperatures, the cooling velocity during the manufacture of the amorphous alloy is less critical. The transition elements T also increase the crystallization temperature, however, the Curie temperature of the alloy, is decreased with an increasing metalloid content. Both conditions or properties result in an improved long-duration stability of the magnetic properties of the alloy. The metalloid content is limited toward the top so that the Curie temperature does not sink so low that the alloy is no longer ferromagnetic at a normal temperature.

It is particularly favorable when the following conditions are met for the metalloid component of the alloy according to the application:

$$10 \leqq xt \leqq 20,$$

$$10 \leqq yt \leqq 20, \text{ and}$$

$$0 \leqq zt \leqq 5.$$

The manganese content at which the zero passage of the magnetostrication constant occurs becomes smaller with an increasing metalloid content of the alloy as well as with increasing components of nickel and the remaining transition elements T. Thus, by approximation, the relationship $d=0.09-0.001\ (t-25+10b+10c)^2$ with the secondary condition $0.01 \leqq d$ is valid for the manganese content of the alloys with a saturation magnetostriction constant $\lambda_s=0$.

Alloys with the amount of the magnetostriction constant $|\lambda|_s \leqq 3\cdot 10^{-6}$ are preferably obtained with manganese contents for which the following relationships are valid:

$$0.05-0.001\ (t-25+10b+10c)^2 \leqq d+e \leqq$$

$$0.13-0.001\ (t-25+10b+10c)^2,$$

$$0.01 \leqq d \leqq 0.13$$

$$0 \leqq e \leqq 0.02$$

One obtains magnetostriction constants $|\lambda|_s \leqq 1\cdot 10^{-6}$ for a given manganese content for which the following relationships are valid:

$$0.07-0.001\ (t-25+10b+10c)^2 \leqq d+e \leqq$$

$$0.11-0.001\ (t-25+10b+10c)^2,$$

$$0.01 \leqq d\ 0.13,$$

$$0 \leqq e \leqq 0.02.$$

After production of the inventive alloys by means of rapid cooling from a melt, the alloy will exhibit good low-retentivity properties, i.e., low coercivity, high permeability and low AC losses. By means of an annealing treatment below the crystallization temperature, the magnetic properties, particularly of magnetic cores manufactured from the alloy, can often be even further improved. Such a thermal or heat treatment can be undertaken at temperature ranges of approximately 250°-500° C., preferably 300°-460° C., and the treatment can last approximately 10 minutes through 24 hours, preferably 30 minutes through 4 hours. The heat treatment is advantageously undertaken in an inert atmosphere, for example, a vacuum, or a hydrogen, helium or argon atmosphere and in an external magnetic field extending parallel to the tape direction, i.e. in a magnetic longitudinal field, with a field strength in a range between 1 and 200 A/cm, preferably a range of 5 through 50 A/cm.

The shape of the magnetization curve can be adjusted by means of the cooling velocity after the thermal treatment. Thus, there are obtained high permeabilities already for small field amplitudes and also low losses at high frequencies of, for example, 20 kHz by means of quick quenching with quenching velocities between in a range of 400 K and 10,000 K per hour. In contrast thereto, one obtains particularly high maximum permeabilities and low coercive field strengths by means of slow cooling with a cooling velocity in a range of approximately 20 through 400 K per hour in the presence of the magnetic longitudinal field.

DESCRIPTION OF THE PREFERRED EMBODIMENTS

The principles of the present invention are particularly useful in providing an amorphous, low-retentivity alloy for use in magnetic screens, sound heads and magnetic cores.

Figure 1:
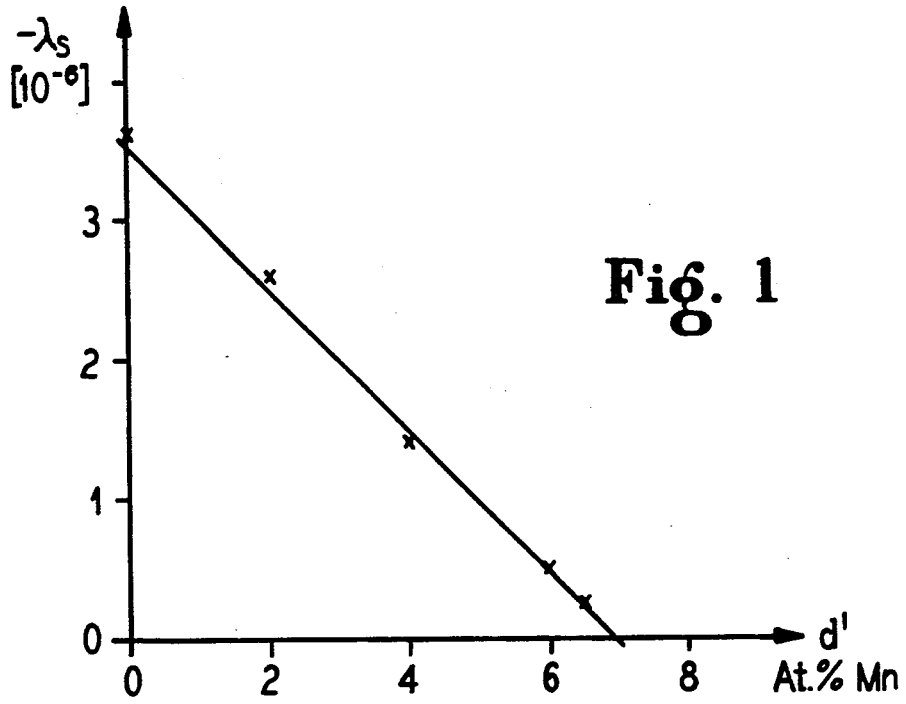
FIG. 1 graphically illustrates the dependency of the magnetostriction constant on the manganese content for alloys of the composition $Co_{75-d}$, $Mn_d$,$Si_{15}B_{10}$.

In FIG. 1, the dependency of the magnetostriction constant on the manganese content is illustrated for examples of the alloys of the composition $Co_{75-d}$,$Mn_d$, $Si_{15}B_{10}$. To this end, the alloys listed in the following Table I were manufactured in the form of tapes with a thickness of approximately 0.04 mm and a width of approximately 2 mm in a manner known per se. For example, the elements of the alloy were melted in a quartz vessel by means of induction heating and the melt was subsequently sprayed onto a rapidly rotating copper drum through an aperture provided in the quartz vessel. A subsequent measurement of the saturation magnetostriction constant $\lambda_s$ produced the following values:

TABLE I

| Alloy | $\lambda_s[10^{-6}]$ | $J_s$[T] | $H_c\left[\frac{mA}{cm}\right]$ |
|---|---|---|---|
| $Co_{75}Si_{15}B_{10}$ | −3.6 | 0.71 | 18 |
| $Co_{73}Mn_2Si_{15}B_{10}$ | −2.6 | 0.75 | 13 |
| $Co_{71}Mn_4Si_{15}B_{10}$ | −1.4 | 0.76 | 11 |
| $Co_{69}Mn_6Si_{15}B_{10}$ | −0.5 | 0.78 | 6 |
| $Co_{68.5}Mn_{6.5}Si_{15}B_{10}$ | −0.25 | 0.78 | 3.5 |

Other than $\lambda_s$, the above Table also indicates the saturation magnetization $J_s$ in T and the coercive field strength $H_c$ in $^{mA}{}_{cm}$. The values relate to the alloy in the state of manufacture without any subsequent thermal or heat treatment.

The relationship between the saturation magnetostriction constant and the manganese content of the alloys is graphically illustrated in FIG. 1, with the magnetostriction constant being indicated on the ordinate and the manganese content d'=d (100-t) being indicated on the abscissa in atomic %. As one can see from FIG. 1, there is a linear relationship between the two magnitudes. The zero passage or value of the magnetostriction constant occurs with the alloy with approximately 7 atomic % manganese.

Similar conditions exist in the other alloys according to the application, whereby the manganese content at which the zero passage or value of the magnetostriction constant occurs, will decrease with increasing components of metalloids, nickel and transition metals T.

A series of additional alloys according to the invention, which were manufactured in accordance to the above example are compiled in the Tables II through IV. The alloys listed in Table II have a particularly low magnetostriction constant $\lambda_s$, a relatively high saturation induction $J_s$ and a very low coercive field strength $H_c$ as measured on the stretched tape even in the state after manufacture without any heat treatment.

TABLE II

| Alloy | $\lambda_s[10^{-6}]$ | $J_s$[T] | $H_c\left[\frac{mA}{cm}\right]$ |
|---|---|---|---|
| $Co_{71.5}Mn_6Si_{8.5}B_{14}$ | −0.3 | 0.95 | 4.5 |
| $Co_{67}Mn_{5.5}Si_{11}B_{16.5}$ | −0.2 | 0.65 | 3.5 |
| $Co_{58.5}Ni_{10}Mn_{7.5}Si_{13}B_{11}$ | −0.4 | 0.70 | 4.0 |
| $Co_{48.5}Ni_{20}Mn_{7.5}Si_{11}B_{13}$ | −0.01 | 0.60 | 1.5 |

In the alloys listed in Table III, the amount of the magnetostriction constant lies at approximately $1\cdot10^{-6}$.

TABLE III

| Alloy | $J_s$ [T] |
|---|---|
| $Co_{69.5}Mn_{6.5}Si_{14}B_{10}$ | 0.80 |
| $Co_{47.5}Ni_{20}Mn_5Si_{11.5}B_{16}$ | 0.30 |
| $Co_{66}Mn_4Si_{12}B_{18}$ | 0.45 |
| $Co_{56.5}Ni_{10}Mn_{3.5}Si_{12}B_{18}$ | 0.25 |
| $Co_{56}Ni_{10}Mn_{6.5}Si_{11}B_{16.5}$ | 0.50 |
| $Co_{66}Mo_3Mn_6Si_{15}B_{10}$ | 0.65 |
| $Co_{66.5}Cr_3Mn_{5.5}Si_{15}B_{10}$ | 0.65 |
| $Co_{69.5}Fe_1Mn_{4.5}Si_{15}B_{10}$ | 0.75 |
| $Co_{67}Mn_6Si_{15}B_{10}C_2$ | 0.65 |

Another group of alloys with a somewhat higher magnetostriction constant in terms of amount are listed in Table IV.

TABLE IV

| Alloy | $\lambda_s$ [$10^{-6}$] | $J_s$ [T] |
|---|---|---|
| $Co_{70}Mo_2Mn_3Si_{15}B_{10}$ | −1.5 | 0.65 |
| $Co_{71}V_1Mn_3Si_{15}B_{10}$ | −2.0 | 0.70 |
| $Co_{73}Mn_2Si_{15}B_{10}$ | −2.5 | 0.72 |
| $Co_{63}Ni_{10}Mn_3Si_{13}B_{11}$ | −2.5 | 0.65 |
| $Co_{54}Ni_{20}Mn_2Si_{11}B_{13}$ | −2.5 | 0.55 |

The influence of the thermal treatment is to be explained on the basis of the following example.

Figure 2:
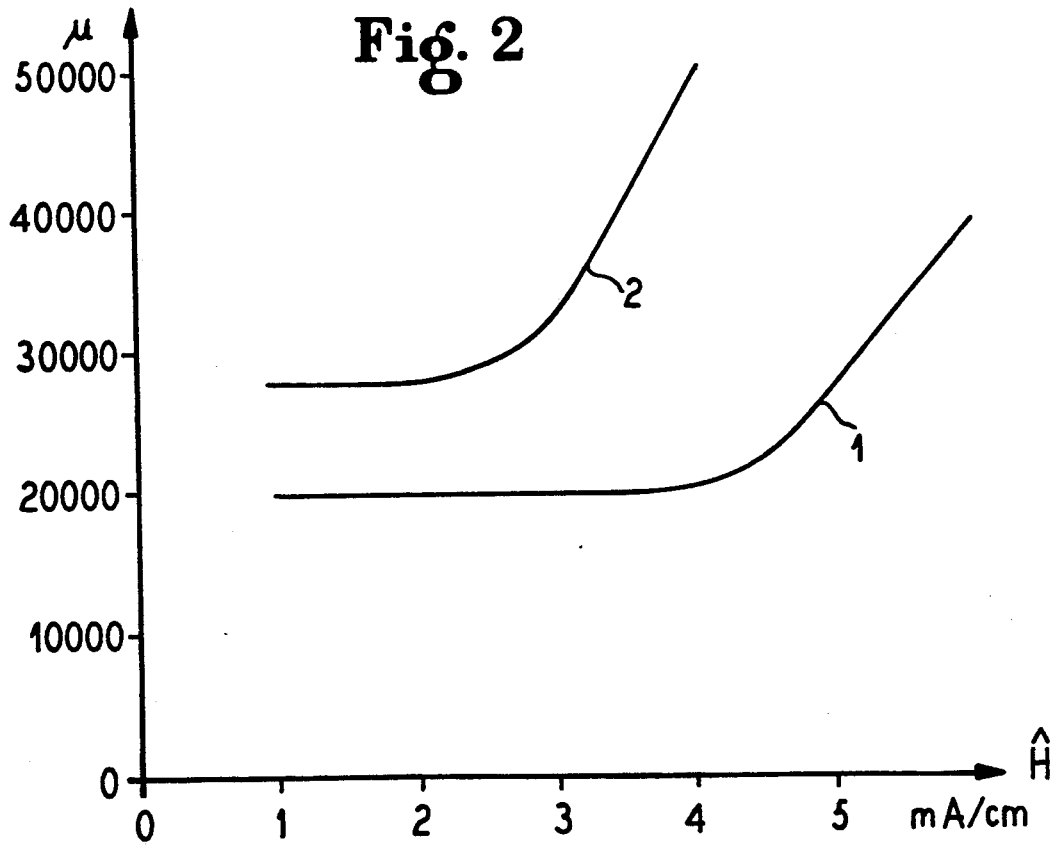
FIG. 2 graphically illustrates the influence of a thermal treatment on the permeability or an alloy of the composition $Co_{48.5}Ni_{20}Mn_{7.5}Si_{11}B_{13}$.

A toroidal core, whose permeability was measured in a magnetic alternating field of 50 Hz, was wound from a tape of an alloy of the composition $Co_{48.5}Ni_{20}Mn_{7.5}Si_{11}B_{13}$ which alloy was manufactured according to the first example. Curve 1 of FIG. 2 shows the dependency of the permeability on the maximum amplitude of the magnetic field with the permeability being indicated on the ordinate and the amplitude $\hat{H}$ of the magnetic field being indicated in $^{mA}{}_{cm}$ on the abscissa. Subsequently, the same core was subjected to a heat treatment at 380° C. for approximately one hour in a hydrogen atmosphere and in a magentic longitudinal field of approximately 10 A/cm. Subsequently, the alloy was cooled in the magnetic field with a cooling velocity of approximately 100 K/h. The subsequent permeabilities, measured in a magnetic alternating field of 50 Hz, are illustrated in curve 2 of FIG. 2.

The alloys according o the application are particularly suitable as a material for magnetic screens, sound heads, and magentic cores, particularly when he latter are to be operated at higher frequencies, for example, at 20 kHz. Further, due to their low magnetostriction and their low-retentivity properties which are already very good in the manufacturing state, the alloys according o the application are also particularly suited for employments in which the low-retentivity material must be deformed and a heat treatment is subsequently no longer possible.

Although various minor modifications may be suggested by those versed in the art, it should be understood that I wish to embody within the scope o the patent granted hereon, all such modifications as reasonably and properly come within the scope of my contribution to the art.

I claim:

1. An amorphous, low-retentivity alloy, which contains cobalt, manganese, silicon and boron, having a composition $$(Co_aNi_bT_cMn_dFe_e)_{100-t}(Si_xB_yM_z)_t,$$

wherein T is at least one o the elements Cr, Mo, W, V, Nb, Ta, Ti, Zr, and Hf; and M is at least one of the elements P, C, al, Ga, In, Ge, Sn, Pb, As, Sb, Bi and Be and the following relationships apply:

$0.39 \leqq a \leqq 0.99$, $0 \leqq b \leqq 0.40$, $0 \leqq c \leqq 0.08$, $0.01 \leqq d \leqq 0.13$, $0 \leqq e \leqq 0.02$, $0.01 \leqq d+e \leqq 0.13$, $a+b+c+d+e+=1$, $18 \leqq t \leqq 35$, $8 \leqq xt \leqq 24$, $4 \leqq yt \leqq 24$, $0 \leqq zt \leqq 8$, and $x+y+z=1$.

2. An amorphous, low-retentivity alloy according to claim 1, having the following relationships:

$10 \leqq xt \leqq 20$, $10 \leqq yt \leqq 20$, and $0 \leqq zt \leqq 5$.

3. An amorphous, low-retentivity alloy according to claim 2, having the following relationships:

$0.05-0.001\ (t-25+10b+10c)^2 \leqq d+e \leqq$ $0.13-0.001\ (t-25+10b+10c)^2$, $0.01 \leqq d \leqq 0.13$, and $0 \leqq e \leqq 0.02$.

4. An amorphous, low-retentivity alloy according to claim 3, wherein he following relationships occur:

$0.07-0.001\ (t-25+10b+10c)^2 \leqq d+e \leqq$ $0.11-0.001\ (t-25+10b+10c)^2$, $0.01 \leqq d \leqq 0.13$, and $0 \leqq e \leqq 0.02$.

5. An amorphous, low-retentivity alloy according to claim 1, having the following relationships:

$0.05-0.001\ (t-25+10b+10c)^2 \leqq d+e \leqq$ $0.13-0.001\ (t-25+10b+10c)^2$, $0.01 \leqq d \leqq 0.13$, and $0 \leqq e \leqq 0.02$.

6. An amorphous, low-retentivity alloy according to claim 5, having the following relationships:

$0.07-0.001\ (t-25+10b+10c)^2 \leqq d+e \leqq$ $0.11-0.001\ (t-25+10b+10c)^2$, $0.01 \leqq d \leqq 0.13$, and $0 \leqq e \leqq 0.02$.

* * * * *